United States Patent [19]

Müller-Späth

[11] Patent Number: 4,620,582

[45] Date of Patent: Nov. 4, 1986

[54] PROCESS FOR PRODUCING A CASTING MOULD AND CAST MEMBERS

[76] Inventor: Gerhard Müller-Späth, Heuslingstr. 19a, Freudenberg-Oberfischbach, Fed. Rep. of Germany

[21] Appl. No.: 624,017

[22] Filed: Jun. 25, 1984

[30] Foreign Application Priority Data

Jul. 1, 1983 [DE] Fed. Rep. of Germany ..... 3323697

[51] Int. Cl.[4] ..... B22C 9/00

[52] U.S. Cl. ..... 164/5; 164/24; 164/33

[58] Field of Search ..... 164/5, 24, 33, 138

[56] References Cited

FOREIGN PATENT DOCUMENTS 2405113 8/1975 Fed. Rep. of Germany ..... 164/5

56-4343 1/1981 Japan ..... 164/24

*Primary Examiner*—Nicholas P. Godici

*Assistant Examiner*—Richard K. Seidel

*Attorney, Agent, or Firm*—Bachman & LaPointe

[57] ABSTRACT

A process for producing a casting mould with chemically bound moulding material using a pattern is intended to make it possible to forego the use of clay-bound sand, in particular for the mass production of cast members, and to provide a casting mould of adequate gas permeability, which is simple to produce, with a low level of consumption of moulding material, and inexpensive, and which also provides a high level of casting quality wth a low degree of environmental pollution. For that purpose, the moulding material which has become pourable or fluid due to the operation of casting a cast member is removed from a first casting mould comprising a single moulding material, whereas the remaining portion of the moulding material is left, and the hollow space formed when the pattern is re-fitted is filled with moulding material. In addition, the moulding material which has been reduced in strength may be also removed, being for example blown or brushed out.

4 Claims, 7 Drawing Figures

Fig.3
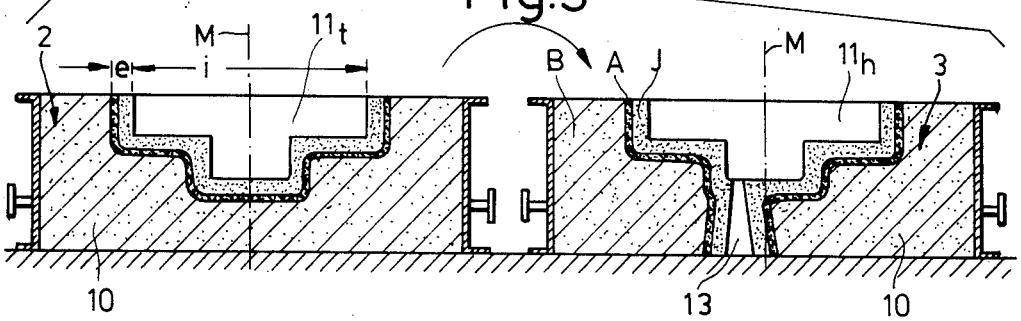
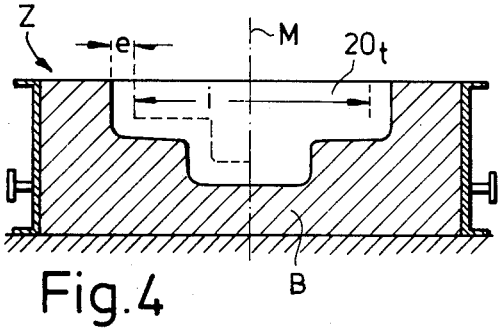
Fig.4
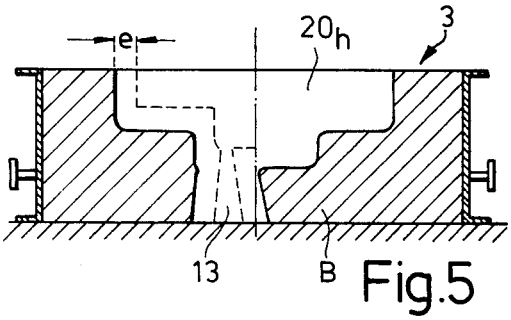
Fig.5
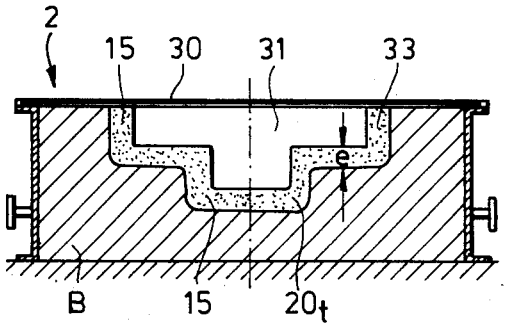
Fig.6
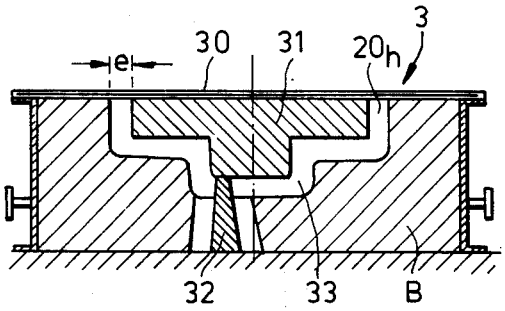
Fig.7

PROCESS FOR PRODUCING A CASTING MOULD AND CAST MEMBERS

BACKGROUND OF THE INVENTION

The invention relates to a process for producing a casting mould with chemically bound moulding material using a pattern and a process for producing cast members.

A hollow space is produced in the moulding material, as part of a mould cavity for the cast member, and the mould cavity is filled with liquid metal, with a region which is influenced by the casting temperature being formed around the cast member in the moulding material. The man skilled in the art is aware of a number of different processes for producing cast members from liquid metal in a casting mould, wherein the mould cavity is formed using a pourable moulding sand with binding agent added thereto, and a model or pattern which is temporarily introduced into the moulding sand.

Thus for example in the sand casting hand moulding process, the process of making the mould from mould sand is effected using continuous-type mixers and manual operations, with a hand tamper, compressed air tamper or slinger device, giving a casting mould which can be used once. In the sand casting machine moulding process, casting moulds and cores are produced by means of mould or core blowing machines. Casting sand as the moulding material is introduced into moulds by shaking or jarring, pressing or squeezing under vacuum or by explosions, and thus compacted in the mould. Core moulds are generally shot out. The casting mould and the core can only be used once.

The shell moulding process uses heated metal patterns and core boxes for producing shell moulds and shell cores from sands which are bound with synthetic resin. In that case also, each shell and each core can only be used once.

Solid mould casting processes use patterns which can be used once and which are cut out of plastics foam and which are shaped in accordance with the hand moulding process but which remain in the casting mould. The moulding materials used here are foundery sands with for example cold-setting binders. That process is suitable both for the individual production of medium and large castings and also for mass production if foamed patterns are pre-fabricated on a mass production basis in special moulds.

Chemically bound sand moulds are successfully used in hand moulding, for individual production and for core production. In the realm of small-scale mass production, use is made of chemically bound sand moulds in the form of shells which are supported by cover shells or gas-pervious back-filling materials, for example by means of loose sand or steel shot.

In mass production processes, cast members are preferably made in iron moulds or green sand moulds. Factors that may be considered as advantages of green sand moulds over casting moulds comprising chemically bound sand are the low moulding material costs as well as the possibility of using production-tested automatic mould machines which permit short cycle times. However, the disadvantages of the green sand mould over chemically bound moulds predominate, namely:

- high requirements in regard to quality of sand and binding agent;
- large amounts of moulding material required;
- binding agents are becoming scarce;
- expensive sand preparation and treatment, inter alia due to a large amount of space being required and long cooling sections;
- the need for two sand systems for the casting mould and the core;
- high energy expenditure;
- moulding and casting defects with just slight fluctuations in moulding material;
- large tolerance range;
- poor cast surfaces;
- a high level of cleaning expenditure;
- a high reject rate;
- the need for a high level of training of the operating personnel;
- serious environmental pollution.

Having regard to those factors, the inventor now set himself the aim of providing a process for producing a casting mould of the kind referred to in the opening part of this specification, and thus cast members, by means of which it is possible to forego the use of clay-bound sands, in particular for the mass production of cast members, thereby avoiding the above-mentioned disadvantages, and providing a casting mould of adequate gas permeability, which is simple to produce, with a low level of consumption of moulding material, and inexpensive, and which also ensures a high degree of quality of casting with a low level of environmental pollution.

SUMMARY OF THE INVENTION

That object is achieved in that, from a first casting mould which is made from a chemically bound moulding material, after the step of casting a first cast member, there is removed at least the portion of the moulding material which has become pourable or fluid in the region affected by the casting temperature, while the remaining portion of the moulding material is left and the hollow space which is formed when the pattern is applied is filled with moulding material to restore the mould cavity, before the next following casting operation. In addition, in an advantageous aspect, besides the pourable portion of moulding material, that portion of moulding material which has been reduced in strength in an adjoining region can also be removed.

In accordance with another feature of the invention, the chemically bound moulding material is moulding sand.

It has also been found desirable for the casting mould to be made in a mould box if the invention is also to be used in relation to box-less casting moulds.

Those measures make it possible to minimise the amounts of moulding material required, without the need of known aids such as shells or support materials to reduce the amount of moulding material used; shells or support materials as just referred to give rise to the need for expensive manual operation and additional preparation costs.

When carrying the process according to the invention into effect, during the first phase, the pattern is formed, in which respect the operation of introducing the moulding sand or moulding material can be effected in the usual manner for example by blasting and sucking. The casting mould is then smoothed, if required, in known manner, supplemented by cores and put together.

After the casting operation, the casting mould is passed in known manner through a cooling section and then split up and the set cast member is removed.

The proportion of moulding material which has become pourable or fluid due to the casting temperature, in the direct vicinity of the cast members, as well as the moulding material which is also reduced in strength, in an adjoining outward region and which breaks up without any major action thereon, is now cleaned out, blown out or shaken out, in accordance with the invention; the portion of moulding material which has hardly been subjected to any thermal loading is left in the mould and, from the second moulding phase, forms a back-filling material with all the advantages of a conventional sand mould (gas permeability and the like).

Thus, further features of the invention are considered to be that, on the one hand, the casting mould is made with unitary moulding material and on the other hand, the portion of moulding material which is in the region affected by the heat of moulding is removed, preferably without using mechanical tools, and that region which has been affected by heat is filled up with the same moulding material.

It is also in accordance with the invention for the portion of moulding material which is removed from the region that has been affected by heat to be regenerated and recycled to that region.

By virtue of the process described, it is possible to operate with a unit mould box size as the necessary hollow space between the pattern and the shell which has firmly remained in position is formed by the thermal loading of the liquid metal. There is no need to use displacement members for supplying filling quantities, for example inflatable hoses, knobs or lumps of old or used sand, coarse sand or styropor, with the manual handling expenditure that that involves.

The following advantages are achieved:

- the mould and the core can be made from one moulding material;
- the quantity of moulding material introduced from the second phase on, is given by the casting process;
- the amount involved in the sand recovery operation is small;
- the quality of the sand is in most cases very good, due to the thermal loading thereon, and may even be better than new sand (new sand only needs to be added to make up for shrinkage or leakage);
- dumps are less heavily burdened;
- there is no longer the noise nuisance when knocking out;
- the recovery plant can be of low capacity; and
- the amount of liquid metal may in many cases be lower (riserless casting), which results in a reduction in the melting costs.

The casting mould only has to be freed of moulding sand when changing to a larger pattern; the halves of the box may be for example blasted clean in the blasting works, but it is also possible to envisage a sand knocking-out location.

This process reduces the amounts of moulding material required to such an extent that a sand/casting ratio below 2:1 is reached; in the green sand process, sand/casting ratios of 12:1 are not unusual. The reduction in moulding sand due to the process according to the invention is considerable.

BRIEF DESCRIPTION OF THE DRAWINGS

Further advantages, features and details of the invention will be apparent from the following description of a preferred embodiment and with reference to the drawings in which:

FIG. 3 shows the operation of separating parts of the box which is shown in cross-section, and FIGS. 4 through 7 show parts of the box in cross-section, diagrammatically illustrating different steps in the process.

DETAILED DESCRIPTION

Figure 1:
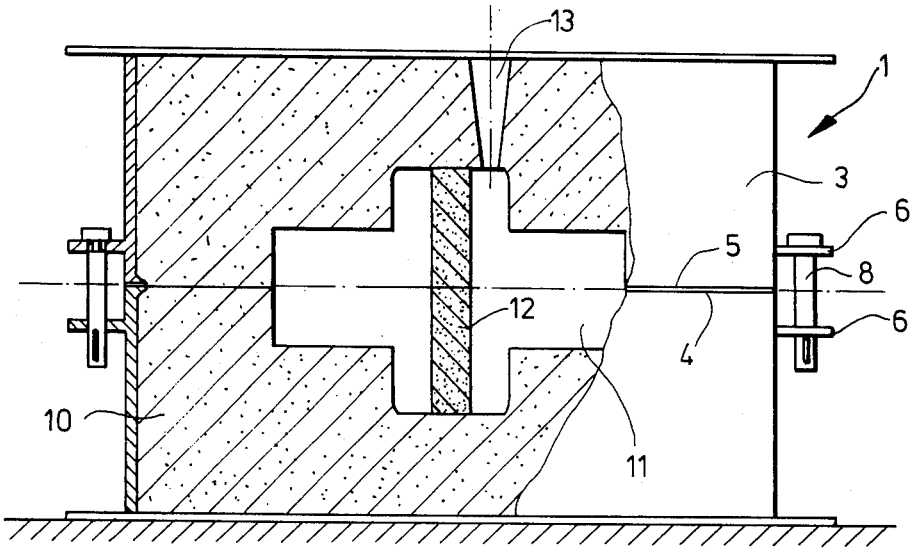
FIG. 1 is a side view of a casting box, partly in cross-section, for casting a cast member.
Figure 2:
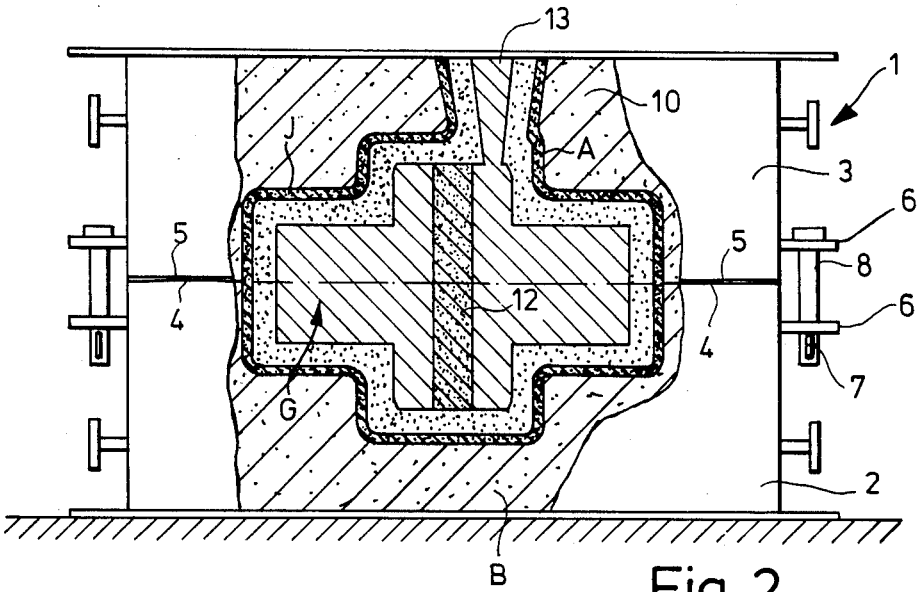
FIG. 2 shows a view corresponding to that shown in FIG. 1, of the box after the casting operation.

A mould box 1 as shown in the drawing, for casting a cast member, includes a bottom box portion 2 and a top box portion 3, the free edges 4 and 5 of which lie one upon the other, with the box portions 2 and 3 being connected by guide pins 8 which are carried in bracket bars 6 and which have a wedge member 7 passing therethrough.

The box 1 encloses a moulding material bed 10 comprising cold resin-bound quartz sand, in the centre of which can be seen a mould cavity 11 with core 12 for the cast member G which is to be subsequently formed therein. A pouring gate for liquid metal is denoted by reference numeral 13; feed means, runner or pouring basins and the like are not shown in the drawing for the sake of enhanced clarity thereof.

During the operation of casting the cast member G and for a short time thereafter, the moulding material changes in the region adjoining the metal; the moulding material which is directly against the cast member G breaks up in an inner region J under the influence of the casting heat to form a sand-like heap, and undergoes crusting in a second region A which is emphasised in black in the drawing, outside which the moulding material of the mould bed 10 is exposed to such a slight thermal loading that it, and therewith the strength of the part of the moulding bed formed thereby in a region B, remain substantially unaltered.

In order to remove the cast member G and the core 12, the top box portion 3 is lifted away from the bottom box portion 2 and set down in an inverted position (see FIG. 3).

Moulding material which previously formed the mould bed 10 and which has become pourable or fluid, in the inner region J, can be readily removed, for example by being blown out. In addition, the portion of moulding material in the regions J and A which have been affected by the heat, which portion has remained somewhat firmer but has become looser in comparison with its original strength value, can be easily removed over the entire width e thereof, so that the width i of the mould cavity 11 is then increased by that width e on both sides of the centre line M of the box, both in the region of the lower mould cavity portion $\mathbf{11}_l$ and also in the region of the upper mould cavity portion $\mathbf{11}_h$. The resulting recesses or clearances are identified by references $\mathbf{20}_l$ and $\mathbf{20}_h$ in FIGS. 4 and 5.

A pattern 31 which hangs from a pattern plate 30 is then fitted into the recesses $\mathbf{20}_l$ and $\mathbf{20}_h$; between the remaining region B of the moulding material bed 10 and the pattern 31 or an insertion plug 32 in the region of the pouring gate 13, there remains a filling gap or clearance 33 of the above-mentioned width e which is now filled with moulding material, as indicated at 15; after the operation of introducing the moulding material at 15 (see FIG. 6), the configuration of the original moulding cavity 11 is restored, for a fresh casting operation.

The portions of moulding material which are removed from regions J and A by being blown out or in some other manner are re-processed in the usual fashion and can then be used again as the portion of moulding material 15 for restoring the cavity 11.

I claim:

1. A process for producing a sand casting mold comprising providing an empty mold box having a top and a bottom, completely filling said top and said bottom with a single homogeneous chemically bound molding material about a pattern so as to form shaping surfaces in the molding material in said top and bottom of said mold box, removing said pattern from said top and bottom, locating said top of said mold box on said bottom of said mold box such that said shaping surfaces define a mold cavity, feeding molten metal into said mold cavity wherein only molding material in the region of said molten metal becomes pourable due to break down of the binder from the heat of the casting, removing said cast metal and pourable molding material from said mold cavity so as to form an enlarged cavity, locating a pattern in said enlarged cavity so as to define a space between the remaining mold material and said pattern and filling said space with said molding material so as to define a further mold cavity.

2. A process according to claim 1 including processing and recycling to said space between the remaining molding material and said die the removed pourable molding material.

3. A process according to claim 1 including blowing the pourable molded material from said mold cavity.

4. A process according to claim 1 including sweeping out the pourable molded material from said mold cavity.

* * * * *